United States Patent [19]

Ford

[11] 3,978,923

[45] Sept. 7, 1976

[54] INJECTION SUB FOR DUAL TUBE DRILLING

[75] Inventor: George Alan Ford, Houston, Tex.

[73] Assignee: Walker-Neer Manufacturing Co., Inc., Wichita Falls, Tex.

[22] Filed: Oct. 14, 1975

[21] Appl. No.: 621,655

[52] U.S. Cl. ..... 166/224 R; 166/242; 175/215; 137/155

[51] Int. Cl.[2] ..... E21B 43/00; E21B 21/00

[58] Field of Search ..... 166/224 R, 242; 175/215; 137/155; 138/114

[56] References Cited

UNITED STATES PATENTS

| | | | |
|---|---|---|---|
| 2,228,318 | 1/1941 | Klise | 137/155 |
| 3,208,539 | 9/1965 | Henderson | 175/215 |
| 3,268,017 | 8/1966 | Yarbrough | 175/215 |
| 3,496,953 | 2/1970 | Garrett | 137/155 |
| 3,937,280 | 2/1976 | Dinning | 166/242 |

*Primary Examiner*—James A. Leppink
*Attorney, Agent, or Firm*—Hume, Clement, Brinks, Willian, Olds & Cook, Ltd.

[57] ABSTRACT

An injection sub for use with a string of dual concentric drill pipe, having inner and outer tubular members concentrically arranged to mate with the inner and outer pipes of the drill string to provide continuous isolated annular and central passageways, is particularly characterized by an annular chamber in the inner member. Ports permit the flow of fluid from the annular passageway to the chamber, and apertures permit fluid flow from the chamber to the central passageway. An annular check valve in the chamber cooperates with the ports to prevent flow from the chamber to the annular passageway.

5 Claims, 3 Drawing Figures

FIG. 1
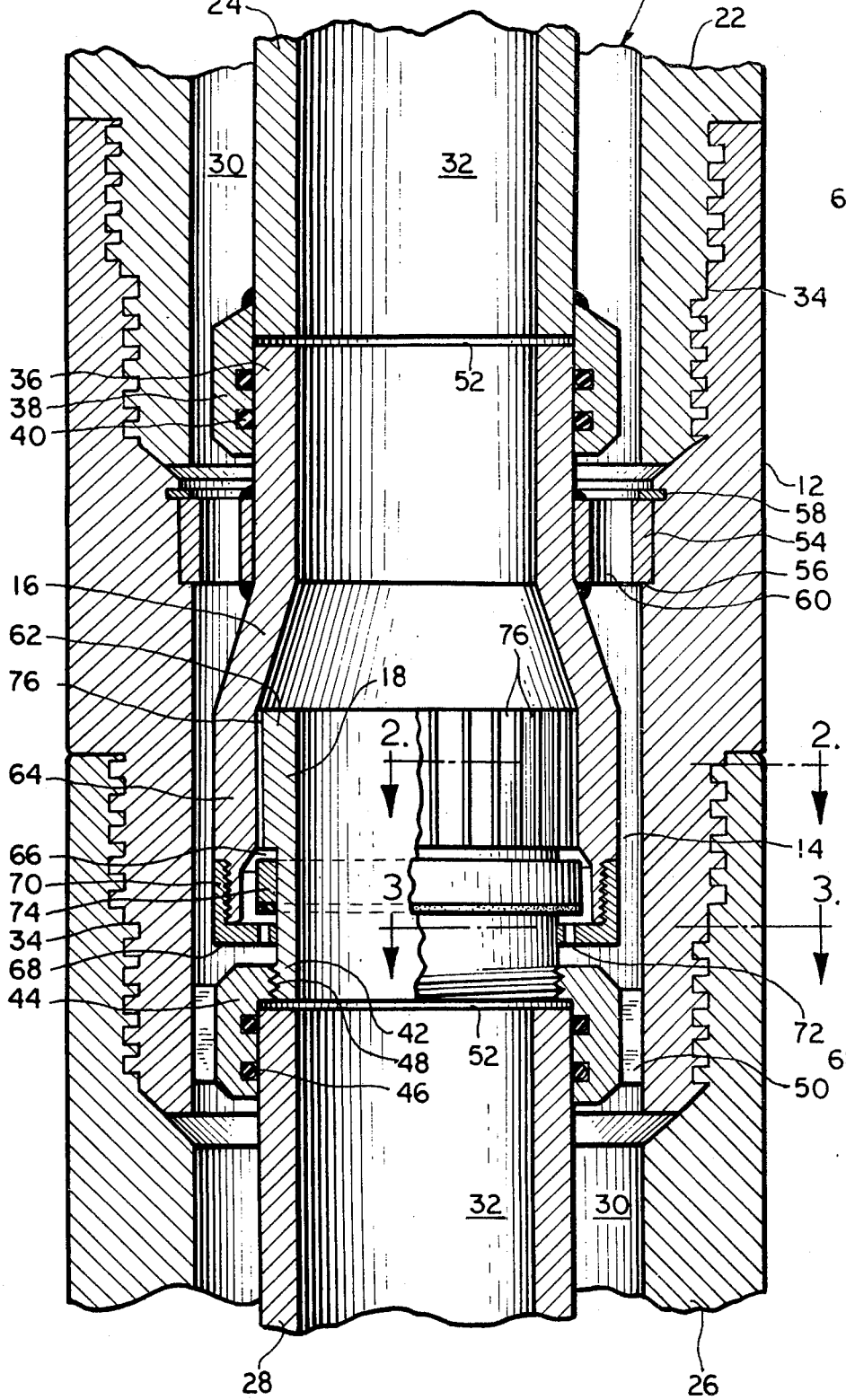
FIG. 2
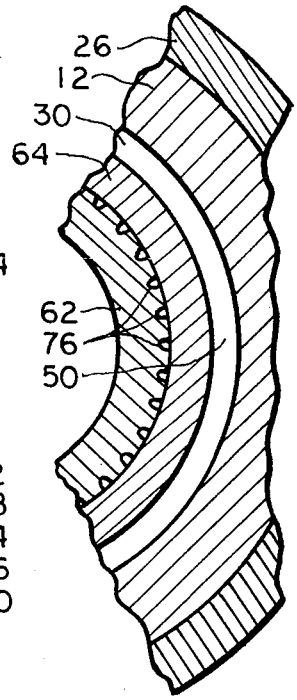
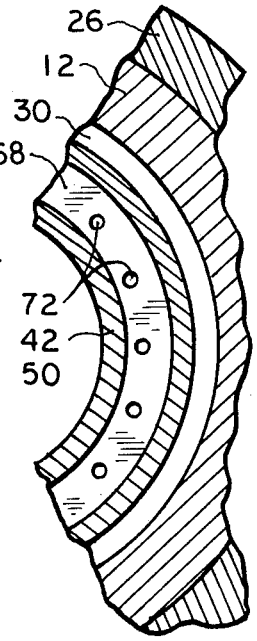
FIG. 3

INJECTION SUB FOR DUAL TUBE DRILLING

BACKGROUND OF THE INVENTION

Dual concentric drill pipe systems are particularly useful for air lift drill techniques, especially air lift reverse circulation drilling. A system for reverse circulation dual tube drilling is disclosed in Henderson U.S. Pat. No. 3,208,539.

In conventional circulation, single tube drilling systems, drilling fluid (e.g., mud or water) is pumped down the drill pipe to the bit, and returns to the surface in the annular space between the drill pipe and the hole wall (the hole annulus). An accepted technique involves the injection of compressed air into the drilling fluid, usually by means of an auxiliary air line, to assist in lifting the cuttings from the bottom of the hole to the surface.

The use of dual concentric drill pipe can greatly expand the possible applications of the air lift technique. In a dual tube system, such as shown in the above mentioned Henderson patent, an inner tube is disposed concentrically within an outer tube, thus defining a continuous annular flow passage between the two tubes (the pipe annulus or annular passageway) and a continuous flow passage through the inner tube (the central passageway). Air lift techniques can be used in such systems in a variety of ways. For example, a heavy drilling fluid such as mud or water can be pumped or allowed to pass down the hole through the hole annulus to the bit. At the same time, compressed air is pumped down the pipe annulus. The cuttings and drilling fluid then pass upward to the surface through the central passageway inside the inner tube. The compressed air in the pipe annulus is either injected into the inner tube at a location above the bit or passes around the bit and into the inner tube, and assists in lifting the cuttings upward. As another example, it might be desired to drill using only air, with no circulation in the hole annulus, such as in water bearing formations. In such an application, air would again be pumped down the pipe annulus, around the bit and into the inner tube. This air assists in the cutting process and would also serve to lift the cuttings and formation water out of the hole into the inner tube.

In such applications, it has been found that pump efficiency and lifting capacity may be greatly enhanced by introducing compressed air in one or more stages along the length of the drill string. It has also been found that the most efficient and desirable method for injection of air requires a system which minimizes turbulence and which causes the air to enter the water or mud stream in the inner pipe in extremely small bubbles.

SUMMARY OF THE INVENTION

The present invention provides an air lift diffuser staging sub capable of injecting air into the inner tube of a dual tube drilling system in a very efficient manner at any desired point along the drill string. This is achieved by providing a sub which includes inner and outer tubular members concentrically disposed and adapted to be joined with corresponding inner and outer pipes of a dual tube string. An annular chamber is provided in the inner tubular member, with ports providing fluid communication between the pipe annulus and the chamber. A check valve in the chamber prevents the flow of fluid back from the chamber into the pipe annulus. A series of small, regularly spaced apertures provides fluid communication between the chamber and the central passageway within the inner tube. Thus air from the annulus is allowed to enter the chamber and is diffused smoothly into the central passageway.

The general object of the present invention is to provide an air lift diffuser staging sub for use in air lift reverse circulation techniques, which greatly increases air pump efficiency and the lifting capacity of the system. Other objects of the invention will become apparent upon consideration of the following description, with reference to the appended drawings, in which:

FIG. 1 is a transverse sectional view of an injection sub embodying the present invention;

FIG. 2 is a fragmentary cross sectional view taken on the line 2—2 of FIG. 1; and FIG. 3 is a view similar to that of FIG. 2, taken on the line 3—3 of FIG. 1.

DESCRIPTION

With reference to the drawings, there is shown in FIG. 1, as an example of one form in which the present invention may be embodied, an injection sub generally designated by the numeral 10. The injection sub 10 includes an outer tubular member 12, and an inner tubular member generally designated by the numeral 14 disposed concentrically therein. In the embodiment shown in FIG. 1, the inner tubular member 14 actually comprises a first inner tubular member 16 and a second inner tubular member 18, although it is possible to construct the inner member 14 as a single unit.

At the upper end of the injection sub 10 is shown a portion of an element of a dual concentric drilling system, generally designated by the numeral 20. The element 20 may be, for example, a segment of dual tube pipe having concentric outer and inner pipes 22 and 24, respectively. Similarly, at the lower end of the sub 10 there is shown a portion of a dual tube drilling element having respective outer and inner pipes or tubes 26 and 28. The inner tubes 24 and 28 are concentrically disposed within the outer tubes 22 and 26, respectively, and together these tubular members define an annular passageway or pipe annulus 30 and a central passageway 32.

The outer tube 12 of the injection sub 10 is connected at each end to the outer tubes 22 and 26 of the dual tube elements in familiar fashion, as by a threaded pipe joint 34. The inner tubular member 14 of the injection sub 10 communicates at each end with the inner tubes 24 and 28 of the dual tube elements. In this manner, the annular passageway 30 and the central passageway 32 are maintained without interruption through the length of the injection sub 10.

In the embodiment shown in FIG. 1, the upper end 36 of the first inner tubular member 16 is adapted for telescopic interconnection with the inner pipe 24. A seal box 38, containing O-rings 40 is affixed to the lower end of the inner pipe 24, and the upper end 36 of the inner tube 16 is inserted therein. The O-rings 40 provide a slidable fluid tight seal, thus isolating the central passageway 32 from the annular passageway 30. In like manner, the lower end 42 of the second inner tubular member 18 is provided with a seal box 44 containing O-rings 46. The upper end of the inner pipe 28 is telescopically disposed within the seal box 44, again providing a fluid tight seal. The seal box 44 is preferably removably attached to the lower end 42 of the second inner tubular member 18, as by threads 48, to permit access to the interior of the sub 10. The seal box 44 may also include a radial spider or centralizing lugs 50. Gaps 52 are preferably provided between the inner member ends 36 and 42 and the ends of the inner pipes 24 and 28, respectively, to accommodate a limited degree of axial movement as disclosed in Henderson U.S. Pat. No. 3,208,539.

The inner tubular member 14 of the sub 10 is preferably attached to the outer member 12 at one point only, or along only a limited portion of their lengths, or the members 12 and 14 otherwise include means to accommodate relative expansion or contraction of the two members, also as disclosed in Henderson U.S. Pat. No. 3,208,539. As shown in FIG. 1 first inner tubular member 16 is suspended within the outer member 12 by means of a spider or lugs 54 which rest on a corresponding shoulder 56 formed in the outer member 12. A snap ring 58 serves to maintain the spider 54 against the shoulder 56. Flow passages 60 in the spider 54 are provided to preserve the flow path in the annular passageway 30.

The upper end 62 of the second inner tubular member 18 fits snugly, in concentric or coaxial fashion, within the lower end 64 of the first inner tubular member 16. The members 16 and 18 define therebetween an annular chamber 66. A generally annular valve seat 68 is provided at the lower end 64 of the first inner member 16, to isolate the chamber 66 from the annular passageway 30. The valve seat 68 is preferably removably attached to the lower end 64 of the tubular member 16, as by threads 70, to permit access to the interior of the chamber 66. The valve seat 68 is provided with a series of ports 72 which permit fluid communication between the annular passageway 30 and the chamber 66.

Disposed within the chamber 66 is a generally annular check valve 74 which is positioned concentrically about the outer surface of the second inner member 18 so that it may slide axially with respect thereto. The valve 74 responds to a pressure differential between the annular passageway 30 and the chamber 66 to open the ports 72 and permit fluid to pass there through; conversely, when the pressure differential is reduced, gravity causes the check valve 74 to close the ports 72.

The upper end 62 of the second inner tubular member 18 includes a series of circumferentially spaced grooves or apertures 76 which permit fluid communication between the chamber 66 and the central passageway 32. Thus, a fluid, such as compressed air, is pumped down the pipe annulus 30, and by operation of the check valve 74 a portion of it is permitted to pass into the chamber 66 through the ports 72. From the chamber 66 the air passes through the grooves or apertures 76 into the central passageway 32.

The ports 72 are preferably small round holes, regularly spaced circumferentially around the valve seat 68. The apertures 76 are also regularly spaced about the upper end 62 of the second inner member 18, and are preferably substantially smaller than the ports 72. The aperture 76 should be made as small as possible without sacrificing the air lift capability of the system. It is preferable to make the apertures 76 small enough to achieve virtual diffusion of the air into the central passageway 32. It is also preferably to position the aperture 76 so that the air exits therefrom along the inner surface of the inner tube 16, creating a minimum of turbulence. Although various sizes and spacings of the ports 72 and apertures 76 are permissible, it has been found that excellent results may be achieved by making the ports 72 one-sixteenth inch in diameter with a center to center spacing between ports of one-quarter to three-eighths inch, and by reducing those corresponding dimensions by more than one-half in the case of the size and spacing of the aperture 76.

I claim:

1. An injection sub for use with a string of dual concentric drill pipe, comprising:

an outer tubular member threaded at each end for engagement with correspondingly threaded ends of outer pipes of two segments of said string;

a first inner tubular member disposed concentrically within said outer member and adapted at one end for telescopic interconnection with the inner pipe of one of said segments of said string, said outer and first inner members defining an annular fluid passageway;

a second inner tubular member disposed concentrically within said outer member and adapted at one end for telescopic interconnection with the inner pipe of the other of said segments of said string, the other end of said second inner member being adapted to fit snugly within the other end of said first inner member in coaxial alignment therewith to form a continuous fluid conduit through said inner members and inner pipes;

an annular chamber defined between the outer surface of said second inner member and the inner surface of said first inner member;

an annular valve seat extending between said first and second inner members and adapted to isolate said chamber from said annular passageway, said seat including port means to permit fluid communication between said annular passageway and said chamber;

valve means in said chamber to open and close said port means; and a plurality of apertures providing fluid communication between said chamber and said conduit.

2. An injection sub as defined in claim 1, wherein said plurality of apertures comprises a circumferential array of grooves defined between the outer surface of said second inner member and the inner surface of said first inner member.

3. An injection sub as defined in claim 1, wherein said valve means comprises a check valve adapted to prevent the flow of fluid from said chamber to said annular passageway.

4. An injection sub as defined in claim 1, wherein said port means comprises a generally circular array of holes in said valve seat, and said valve means comprises an annular check valve slidably mounted about the outer surface of said second inner member for axial movement thereon within said chamber.

5. An injection sub for use in a dual tube drilling system including a plurality of tubular elements each including concentric inner and outer pipes defining continuous isolated central and annular passageways when said elements are joined, said sub comprising:

an outer tubular member adapted for connection at each end to the outer pipe of one of said elements;

an inner tubular member disposed coaxially within said outer member and adapted at each end for connection to the inner pipe of one of said elements;

an annular chamber in said inner member;

port means adapted to pass fluid from said annular passageway to said chamber;

valve means cooperative with said port means to prevent the passage of fluid from said chamber to said annular passageway; and a plurality of apertures adapted to pass fluid from said chamber to said central passageway.

* * * * *